United States Patent [19]

Thomas et al.

[11] 3,940,326

[45] Feb. 24, 1976

[54] METHOD OF COATING CATHODE HEATERS

[75] Inventors: Martha J. B. Thomas, Winchester; Richard A. Fowler, Ipswich, both of Mass.; Robert C. Larson, Exeter, N.H.

[73] Assignee: GTE Sylvania Incorporated, Danvers, Mass.

[22] Filed: Feb. 16, 1972

[21] Appl. No.: 226,706

[52] U.S. Cl. ..... 204/181

[51] Int. Cl.[2] ..... C25D 13/02

[58] Field of Search ..... 204/181; 117/212

[56] References Cited

UNITED STATES PATENTS 2,966,449 12/1960 Bouchard et al. ..... 204/181

FOREIGN PATENTS OR APPLICATIONS 1,177,489 1/1970 United Kingdom ..... 204/181

*Primary Examiner*—Howard S. Williams

*Attorney, Agent, or Firm*—James Theodosopoulos

[57] ABSTRACT

A solution containing dissolved tungsten and dissolved aluminum is spray dried to recover a tungsten-and-aluminum containing powder. The powder is then fired to eliminate hydrated water and volatiles and to convert the aluminum compound into alumina. The powder is next fired at a higher temperature in a reducing atmosphere to reduce the tungsten compound to elemental tungsten. A coating suspension containing the tungsten-alumina powder is then prepared and electrophoretically deposited on cathode heaters.

8 Claims, No Drawings

METHOD OF COATING CATHODE HEATERS

BACKGROUND OF THE INVENTION

1. Field of the Invention

This invention relates to the field of insulated coated heaters for indirectly heated cathodes of electron discharge tubes and especially to thermally darkened coated heaters.

2. Description of the Prior Art

Examples of dark coated insulated heaters are shown in U.S. Pat. Nos. 3,195,004, 3,246,197, 3,328,201 and 3,450,565. As disclosed in said patents, a dark coating is obtained by mixing particulate alumina (aluminum oxide) with tungsten, the tungsten being either in particulate elemental form or in solution. When the tungsten is used in solution form, it is reduced to the dark elemental state, either after it has been deposited on the aluminum oxide particles or after it has been deposited on a coated heater.

As pointed out in said patents, the purpose of the dark coating is to electrically insulate the heater from the cathode into which it is inserted and to improve the efficiency of heat transfer from the heater to the cathode, a dark coating being more efficient in heat transfer than the usual white alumina coating.

In the heater coatings of the prior art, it is difficult to obtain uniformity of dark color from batch to batch of dark coating.

SUMMARY OF THE INVENTION

In the process of coating a heater in accordance with this invention, an aqueous solution containing predetermined quantities of dissolved tungsten and dissolved aluminum is first prepared. The tungsten may be supplied in water soluble form, such as ammonium tungstate or tungstosilicic acid, or it may be supplied by dissolving tungsten metal, preferably in powder form, in a dissolving liquid, such as hydrogen peroxide or a suitable acid. The aluminum is preferably supplied in water soluble form, such as aluminum nitrate or aluminum chloride, rather than by dissolving aluminum metal in an acid, although the metal could be used provided it has adequate purity to serve as a raw material for a heater insulating coating.

The aqueous solution is then atomized in a stream heated above the boiling point of water to yield a dry fine homogeneous powder containing an aluminum compound and a tungsten compound. The powder is then fired in order to eliminate hydrated water and other volatiles and to form alumina. Next the powder is fired at a higher temperature in a reducing atmosphere to reduce the tungsten to elemental form, the alumina remaining unreduced. Also, the firing temperature is not sufficiently high to sinter the particles together. Finally the powder is fired at a still higher temperature to crystallize the product, this firing being in an inert or reducing atmosphere to prevent oxidation of the tungsten. This final product is a dark crystalline homogeneous powder in which the ratio of elemental tungsten to alumina in each particle is uniform.

The crystalline powder is then blended into a suitable electrophoretic coating suspension and is electrophoretically deposited on cathode heaters by usual methods such as shown in U.S. Pat. Nos. 2,966,449 and 3,049,482. The dark coating may be deposited directly on a cathode heater as a single coating or it may be deposited as a second coating over a first coating of aluminum oxide. However, improved uniformity of dark color results from the process of this invention.

Although it is preferable, for purposes of insulation resistance, that the tungsten and aluminum containing solution be free of other materials that might remain in the atomized-and-fired powder, some tolerance thereof is permitted. For example, a heteropoly tungstic acid such as disclosed in U.S. Pat. No. 3,450,565 may be used, especially tungstosilicic acid. In such a case, the crystallized dark particles would contain a small percentage of silica, which would not generally be detrimental to the heater insulation throughout its normal life.

DESCRIPTION OF THE PREFERRED EMBODIMENT

The following is a specific example of a heater coating process in accordance with this invention. 30 grams of high purity elemental tungsten was dissolved in hydrogen peroxide to make 1.1 liters of solution. 7800 grams of reagent grade aluminum nitrate, $Al(NO_3)_3 \cdot 9H_2O$, was dissolved in 10 liters of water. Both solutions were combined to form a clear solution containing all the aluminum nitrate and dissolved tungsten. 6000 cc of this solution was then diluted with 44000 cc of deionized water and fed to a nine foot diameter, cocurrent spray drier at the rate of 1500 cc/min. Atomization was achieved with the use of an ultrasonic spray nozzle operating with a 180° spray angle at 70 psig air pressure. The spray drier was heated so as to maintain an outlet temperature of 195°C which resulted in rapid evaporation of the atomized droplets and formation of dry homogeneous particles containing aluminum nitrate and tungstic oxide. This particulate material was fired for two hours in an electric furnace at 450°C in an air atmosphere to volatilize hydrated water and nitrogen dioxide and to convert the aluminum nitrate to alumina. Next the material was fired at 800°C for one hour in a 75% hydrogen - 25% nitrogen atmosphere to reduce the tungsten oxide to elemental tungsten. Finally the material was fired at 1200°C for one hour in a similar reducing atmosphere to crystallize the material. The final product was a dark crystalline, homogeneous powder of alumina-tungsten of fine particle size, the tungsten composition of each particle being 3% by weight.

The dark powder was blended into electrophoretic coating suspensions containing methanol, .5 to 1.0% water, .5 to 2.0% aluminum nitrate and 30 to 60% dark powder, all percentages by weight. Coiled cathode ray heaters made from 67 mm of 4.6 mil tungsten wire were electrophoretically coated with one of said suspensions, the average coating weight on each heater being 4.5 mg. The coated heaters were fired at 1650°C in a reducing atmosphere to sinter the coating, which had a dark color of 7 on the Kodak gray scale of 1 to 12. The coated heaters were mounted in indirectly heated cathodes and operated satisfactorily in cathode ray tubes.

We claim:

1. In the process of coating heaters for use with indirectly heated cathodes of electron tubes the steps which comprise: preparing a solution containing dissolved tungsten and dissolved aluminum; atomizing said solution in a stream heated above the boiling point of water to yield dry particles containing an aluminum compound and a tungsten compound; first firing said particles to eliminate volatiles and convert said aluminum compound to alumina; second firing said particles at a higher temperature in a reducing atmosphere to reduce said tungsten compound to elemental tungsten; third firing said particles at a still higher temperature in a reducing atmosphere to crystallize said particles; dispersing said particles in a coating suspension and electrophoretically coating said heaters therewith.

2. The process of claim 1 wherein said dissolved tungsten is ammonium tungstate or tungstosilicic acid.

3. The process of claim 1 wherein said dissolved aluminum is aluminum nitrate.

4. The process of claim 1 wherein said first firing step is at about 450°C.

5. The process of claim 1 wherein said second firing step is at about 800°C.

6. The process of claim 1 wherein said third firing step is at about 1200°C.

7. The process of claim 1 wherein said coating suspension comprises methanol, water and aluminum nitrate.

8. The process of claim 1 wherein said tungsten compound is tungstic oxide.

* * * * *